US010290937B2

(12) United States Patent
Oppenlaender

(10) Patent No.: US 10,290,937 B2
(45) Date of Patent: May 14, 2019

(54) POSITIONING SYSTEM FOR ANTENNAS AND ANTENNA SYSTEM

(71) Applicant: Lisa Draexlmaier GmbH, Vilsbiburg (DE)

(72) Inventor: Joerg Oppenlaender, Kirchentellinsfurt (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 426 days.

(21) Appl. No.: 15/017,450

(22) Filed: Feb. 5, 2016

(65) Prior Publication Data

US 2016/0233579 A1 Aug. 11, 2016

(30) Foreign Application Priority Data

Feb. 6, 2015 (DE) ..... 10 2015 101 721

(51) Int. Cl.

| | |
|---|---|
| ***H01Q 3/08*** | (2006.01) |
| ***H01Q 21/28*** | (2006.01) |
| ***H01Q 1/12*** | (2006.01) |
| ***H01Q 1/28*** | (2006.01) |

(52) U.S. Cl.

CPC ..... *H01Q 3/08* (2013.01); *H01Q 1/125* (2013.01); *H01Q 1/28* (2013.01); *H01Q 21/28* (2013.01)

(58) Field of Classification Search

CPC ..... H01Q 3/08; H01Q 21/28; H01Q 1/125; H01Q 1/28

See application file for complete search history.

(56) References Cited

U.S. PATENT DOCUMENTS 6,034,643 A * 3/2000 Nishikawa ..... H01Q 3/08 343/765
2014/0225768 A1* 8/2014 Engel ..... H01Q 3/08 342/354

FOREIGN PATENT DOCUMENTS

| | | | |
|---|---|---|---|
| JP | H 06252625 | A | 9/1994 |
| WO | WO 2007063434 | A2 | 6/2007 |
| WO | WO 2010124867 | A1 | 11/2010 |
| WO | WO 2014005699 | A1 | 1/2014 |

* cited by examiner

*Primary Examiner* — Hai V Tran
*Assistant Examiner* — Michael M Bouizza
(74) *Attorney, Agent, or Firm* — Finnegan, Henderson, Farabow, Garrett & Dunner LLP

(57) ABSTRACT

A positioning system may include a bracket, a mounting, and a positioner platform. The positioning system may further include an antenna aperture having two opposing sides each attached to the bracket via respective first pivot bearings arranged along a first axis. The antenna aperture may be configured to rotate about the first axis. A second pivot bearing may attach the bracket to the mounting, and may be arranged along a second axis. The bracket may be configured to rotate about the second axis. A third pivot bearing may attach the mounting to the positioner platform, and may be arranged along a third axis. The mounting may be configured to rotate about the third axis.

20 Claims, 12 Drawing Sheets

POSITIONING SYSTEM FOR ANTENNAS AND ANTENNA SYSTEM

CROSS REFERENCE TO RELATED APPLICATION

This application is based upon and claims the benefit of prior German Patent Application No. 10 2015 101 721.0, filed on Feb. 6, 2015, the entire contents of which are incorporated herein by reference.

TECHNICAL FIELD

The present disclosure relates to a positioning system for antennas and to an antenna system, which may be used on vehicles such as aircraft. Low-profile flat-panel antennas used by aircraft to communicate with satellites may be subject to special space constraints regarding the positioning of an antenna aperture in the direction of a satellite.

BACKGROUND

Positioning systems for antennas on mobile carriers, such as vehicles, aircraft or ships, may attempt to optimally align the antenna with a target, such as a target antenna located on a satellite, during the spatial movement of the mobile carrier. A permanent radio relay link may need to be reliably maintained, even when the carrier is moving rapidly.

2-axes positioning systems may be used in many applications, such as that shown in JP H06-252625 A. Such systems can be used for the independent azimuth and elevation rotation of an antenna. The two axes of such systems may form an orthogonal system, and therefore may allow the antenna to be aligned with any arbitrary point in the three-dimensional space.

If the wireless communication system operates with electromagnetic waves having a linear polarization, a problem that may occur with 2-axes systems is that upon a rotation of the antenna, the polarization planes may also rotate, so that the polarization plane of the target antenna no longer agrees with the polarization plane of the antenna located on the positioning system.

To solve this problem, a third antenna can be introduced for spherical-symmetrical volumes through which the antenna is moved (such as for parabolic antennas), which may allow the antenna to be rotated about the beam axis independently of the azimuth and elevation axes. Such a 3-axes system then may form a complete orthogonal system and allows optimal polarization tracking.

The 3-axes positioning systems for parabolic antennas, however, may not be used for low-profile antennas because independent rotation about the beam axis may not be possible due to the shape of the antenna aperture and the low installation space, or the angular range in which such a rotation is possible may be restricted.

In the case of low-profile antennas that support two orthogonal linear polarizations, polarization tracking may therefore be carried out electronically or electromechanically in the signal processing path, so that no third mechanical axis is needed.

One example of such a 2-axes positioning system according to conventional technologies is shown in FIG. 1. As shown in FIG. 1, 2-axes positioning systems having separate polarization tracking 20 may be used in fuselage or body mounted low-profile antennas on aircraft or vehicles. The antenna systems can be characterized in that the antenna apertures have only a very low height (such as less than 20 cm) so as to minimize the aerodynamic drag to the extent possible. The antenna apertures may be rectangular.

However, for antenna apertures that are not rotation-symmetrical on positioning systems having two axes A and C, upon a rotation of the antenna about the elevation or azimuth axis, the antenna pattern may change spatially in relation to the target antenna and the surroundings thereof because the antenna pattern is not rotation-symmetrical.

Geographic skew may therefore arise in the communication with satellites, such as in applications on mobile carriers such as aircraft, which can cover large geographic distances.

Geographic skew may be due to the azimuth axis of the antenna aperture being located in the aircraft plane in a 2-axes positioning system. The aircraft plane may be a tangent plane to the earth's surface. If the aircraft position and the satellite position are not located on the same geographic longitude, the antenna aperture, when it is directed at the satellite, may be rotated with respect to the plane of the Clarke orbit by a certain angle, which may depend on the geographic longitude.

Because the width of the main beam of low-profile antenna apertures can continue to increase as the rotation about the beam axis increases (proceeding from the normal azimuth position), the power spectral density in the transmission operation of the antenna in the fixed satellite service (FSS) may need to be successively reduced to ensure regulatory compliant operation.

The worst case in the FSS may occur when the mobile carrier is below or in the vicinity of the equator. The main beam may then have the maximum width with respect to the tangent to the geostationary orbit at the location of the target satellite, and impermissible irradiation of neighboring satellites may occur.

Problems may also arise in reception because the signals of neighboring satellites may be received together with the signals of the target satellite, and substantially no discrimination may take place via the antenna pattern. The signals of the neighboring satellites then may act as disturbing signals (e.g., noise), which are superimposed on the wanted signal and corrupt the wanted signal. The receivable data rate may decreases in this case.

The reduction of power spectral density of the transmitted signal and the interference of neighboring satellites in the received signal may mean that low-profile antennas cannot to be operated on 2-axes positioning systems in the vicinity of the equator in the FSS, or may only operate with a considerable loss of performance.

SUMMARY

Embodiments of the present disclosure may overcome difficulties in the positioning of antennas.

Embodiments of the present disclosure provide a positioning system and an antenna system.

The positioning system for an antenna aperture, such as a low-profile antenna, according to embodiments of the present disclosure, may comprise a bracket to which the antenna aperture is attached rotatably along a first axis A. The bracket, in turn, may be attached to a second axis B in a second pivot bearing, which is rotatably mounted on a positioner platform on a third axis C in a third pivot bearing. The positioner platform itself may be mounted in a vehicle, or the third pivot bearing may be rigidly connected to the vehicle.

The three axes A, B, C of the positioning system may form a complete orthogonal system, which may allow an antenna aperture to be directed at a target antenna in a manner that is adapted to circumstances such as an installation space that has a limited height.

The rotatable bracket may enable movement about the second axis and create a distance between the antenna aperture and the positioner platform, so that the movement of the antenna aperture about the second axis by the positioner platform can take place uninhibited. The bracket for attaching the antenna aperture may be two-armed or comprise only one arm. In the one arm configuration, the one arm may engage at the geometric center or the center of mass of the antenna aperture.

The first axis may form an oblique angle with the second axis, and the second axis may form an oblique angle with the third axis, which is to say the axes deviate from a right angle. The oblique-angled arrangement of the axes may be used for general installation space volumes. A right-angled arrangement may also be used. Installation space volumes of aircraft antennas may be incrementally cylindrical, which may suit axes arranged at a right angle. In spherical volumes or spherical segment volumes, oblique-angled arrangements may be used because the weight of the system can then be balanced.

The three axes of a positioning system according to embodiments of the present disclosure may not correspond to the generic azimuth, elevation, and antenna beam axes ("skew axes"). However, because the three axes of a positioning system according to embodiments of the present disclosure may represent a complete orthogonal system, the generic axes may be regained by a unitary transformation. The angle settings with respect to the three axes of the positioning system according to embodiments of the present disclosure therefore may unambiguously result from the generic azimuth, elevation, and skew angles by a corresponding unitary rotation in the three-dimensional space. This transformation may be carried out with right angles; however, it is also possible to take angles into consideration that deviate from a perpendicular arrangement of the axes with respect to each other to achieve a mass balance.

A generic rotation about the azimuth axis (azimuth rotation), however, may require a simultaneous rotation about all three axes of the positioning system according to embodiments of the present disclosure. The same may apply to generic elevation and skew rotations. A coordinate transformation, however, can be implemented using algorithms.

Compared to previously known 3-axes positioning systems, which may be composed of generic axes, a positioning system according to the embodiments of the present disclosure may have a number of advantages:

1. Due to the arrangement of the axes, the angular range in which the rotation about the second axis may occur may be limited. The angular range of the movement about the second axis can be limited to approximately ±20°. The main component of a skew rotation having a generic angular range of ±90° may be achieved by a rotation about the third axis. Because the angular range of the third axis may be n×360° (n=∞) (see generic azimuth rotation), this may represent a simplification of the mechanics.

2. In the case of a generic arrangement of the three axes (not according to the present disclosure), the required angular range may be n×360 (n=∞) for the azimuth rotation, 0° to 90° for the elevation rotation, and −90° to +90° for the skew rotation. In an installation space having a limited height, it may be only the software controller that is able to prevent the antenna aperture from leaving the installation space volume, and may make contact with an aerodynamic radome. Mechanical blocks ("hard stops") may not be implemented because such implementation may make it no longer possible to optimally align the antenna. For safety reasons, however, a pure software definition of the volume through which the antenna is moved ("swept volume") may be critical.

An arrangement of the axes according to embodiments of the present disclosure, in contrast, may allow a mechanical block (stop) to be implemented, which can restrict the angular range about the second axis. Accordingly, the antenna aperture can be prevented from leaving the defined swept volume even if the controller fails.

3. The requirements with regard to vibration resistance may be high for aircraft antennas. An arrangement according to embodiments of the present disclosure may be more tolerant to vibrations than the known generic arrangements. This may make it possible to use antenna apertures that have a lower weight because fewer structural provisions may be needed. Antenna apertures in lightweight construction, comprising aluminum or carbon fibers, may be possible with positioning systems according to embodiments of the present disclosure. When the antenna aperture is lighter, the forces the positioning system absorbs during operation may be lower and the system may therefore be designed to have a lighter weight. Lighter antenna apertures and lighter positioning systems may result in weight advantages over known systems.

4. The arrangement of the axes in positioning systems according to embodiments of the present disclosure may allow for more compact designs. Because the required angular range about the second axis may be relatively small and the associated angle may change slowly during operation, any included gearboxes and motors may not be complex. Moreover, during operation, the antenna aperture may cross a smaller area of the installation space volume. This additionally may make it possible to accommodate functional modules, such as an antenna controller box or polarization tracking electronics, without difficulty on a typical positioner platform.

The antenna aperture may be attached by way of the bracket to two opposing sides of the antenna aperture. The bracket may have two arms for this purpose. The antenna aperture may therefore be able to fully rotate between the bracket arms without adding any height. This may be the case when the attachment of the antenna aperture is carried out at the narrow sides of the antenna aperture via a respective first pivot bearing, and driving is carried out via a direct drive, for example.

Further embodiments may provide for a mounting to attach the second pivot bearing to a third pivot bearing, and for the third pivot bearing to be arranged on the positioner platform. The antenna aperture therefore may receive a sufficient height above the positioner platform to carry out minor pivoting movements about the second axis. A supporting aspect may be when the antenna aperture has an oval or stepped oval shape, and has a height to width ratio of 1:≥4.

The height can be further reduced when a third drive is arranged perpendicularly to the positioner platform and drives the third pivot bearing via a toothed ring arranged beneath the positioner platform. The antenna can then be covered by a radome, which may have a key shape and during operation may create only minor aerodynamic resistance.

As an alternative to drives on the pivot bearings, it is possible to carry out a rotational movement about the first axis and/or a rotational movement of the bracket on the second axis by way of a linear actuator.

Due to the restricted movement scenarios for the first pivot bearing and the second pivot bearing, the first and second pivot bearings may be suitable for driving by way of a direct drive, which may not require a gearbox and may therefore save further weight.

A substantially centrally arranged high-frequency rotary feedthrough may be integrated into the third pivot bearing, and may conduct high-frequency signals from and to the antenna aperture, for two high-frequency channels, for example. This may supports the full 360° rotation of this pivot bearing. The high-frequency rotary feedthrough integrated into the third pivot bearing can therefore also be encapsulated more easily and protected well against moisture penetration. In addition, two or more separate slip ring pairs may be integrated into the third pivot bearing to supply the drives of the further moving parts with power and for control purposes. Flexible coaxial conductors may be suitable for the remaining high-frequency connections to the antenna aperture because the second pivot bearing and the first pivot bearing may carry out only very limited rotations, and the flexible coaxial conductors can follow these movements.

It may be advantageous when driving at the pivot bearings is carried out by way of brushless electric motors.

As a result of lower vibrations, it may be possible to use aluminum structures, or even carbon fiber structures, on the mounting and/or the bracket and the like, which may offer another weight advantage.

The described positioning system can be used in an antenna system comprising a first antenna and a second antenna, which use a shared positioning platform and of which at least one uses a positioning system according to embodiments of the present disclosure. In this way only insignificantly more installation space may be required and both antennas can be provided beneath a shared radome. The two antennas may allow for the following application scenarios.

For example, the first antenna can be operated in the Ka band and the second antenna can be operated in the Ku band. Depending on availability or costs of the satellite connection in the Ka or Ku band, it may therefore be possible to select the preferred connection in each case. The respective other antenna then may have no function during operation and may only follow the rotation.

As another example, both antennas may be operated in parallel with each other in the same frequency band, which is to say in the Ka band or Ku band or X band, for example. In the majority of positions of the aircraft from the equator up to the northern latitudes of 48°, the elevation angle of the antenna with respect to a geostationary satellite in the vicinity of the equator may be only up to 30°. In this way, it is also possible for the two antennas to be simultaneously aligned with the satellite and operated parallel to each other. This may improve the signal-to-noise ratio, and the transmitted data rate can be increased.

A further advantageous use of the antenna system relates to a synchronous operation of the two antennas. When the two antennas are symmetrically arranged about the third rotational axis, a synchronous movement of the two antennas also about the first and second rotational axes (known as butterfly operation) may additionally offer the advantage that no additional angular momentum acts on the antenna system, and forces on the motor and gearbox are minimized.

Moreover, further advantages and features of embodiments of the present disclosure will be apparent from the following description. The features described can be implemented alone or in combination with one or more of the above-described features, unless the features contradict each other. The following description is made with reference to the accompanying drawings.

DETAILED DESCRIPTION

Figure 1:
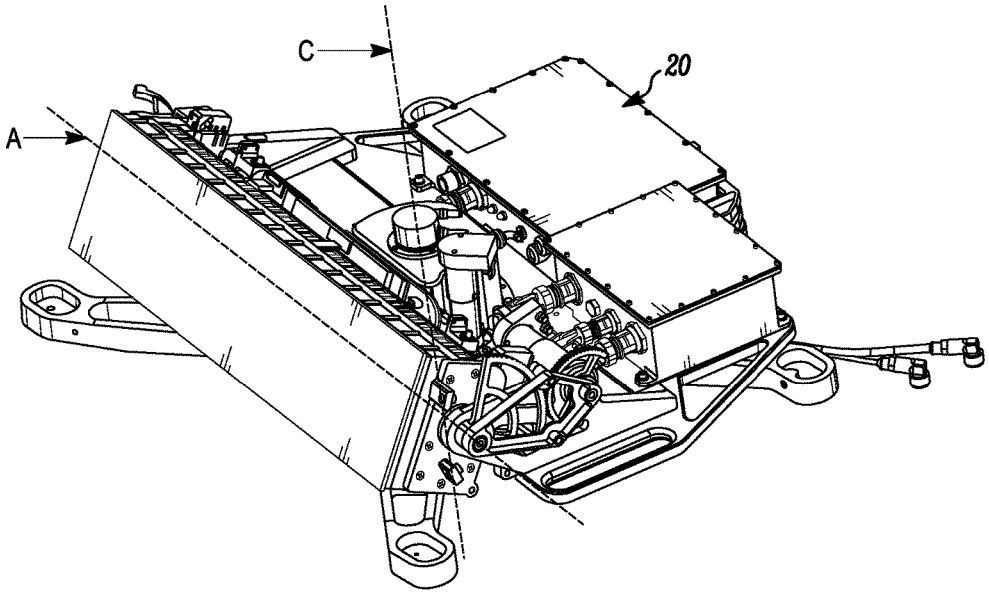
PRIOR ART FIG. 1
FIG. 1 shows a conventional positioning system.
Figure 2:
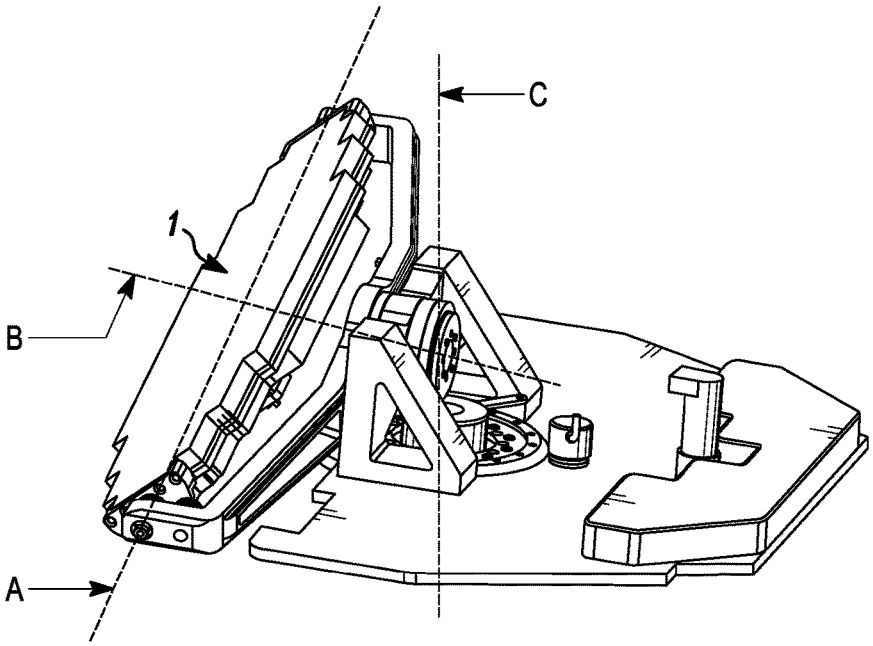
FIG. 2 shows a positioning system according to embodiments of the present disclosure having three axes.
Figure 3:
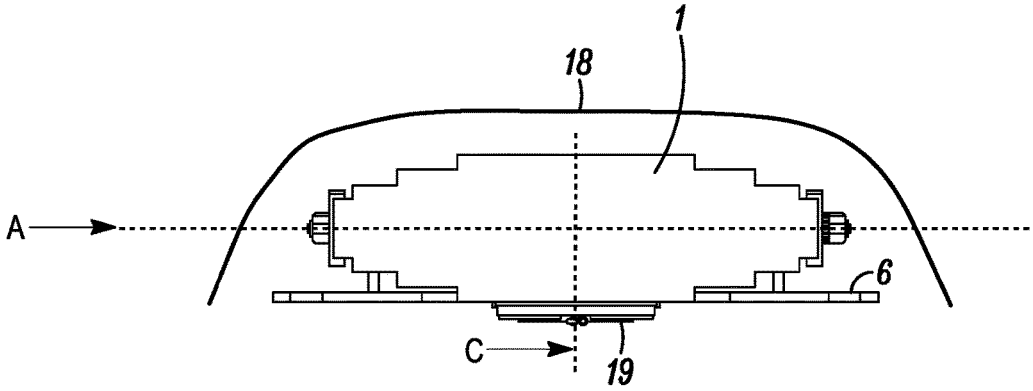
FIGS. 3 and 4 show a positioning system according to embodiments of the present disclosure beneath a radome.
Figure 4:
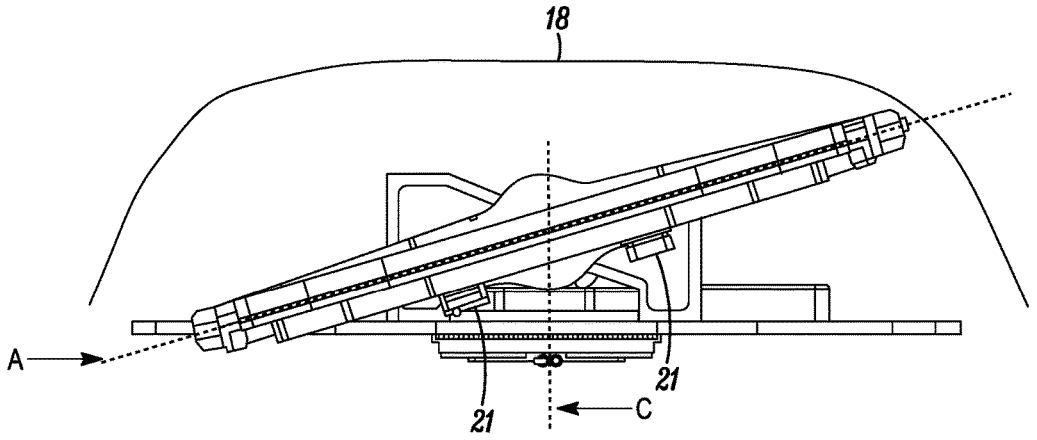

FIG. 2 shows an antenna system having a positioning system consistent with the present disclosure. As shown in FIG. 2, the positioning system is configured to rotate an antenna aperture 1 about a first axis A, a second axis B, and a third axis C. FIG. 3 shows a front view of the antenna aperture 1 at an elevation angle of 0° and a typical swept volume limited by a radome 18. FIG. 4 shows how the angular range of the rotation about the second axis can be limited by a mechanical restriction, such as a stop 21, so that the antenna aperture 1 does not leave the swept volume.

Figure 5:
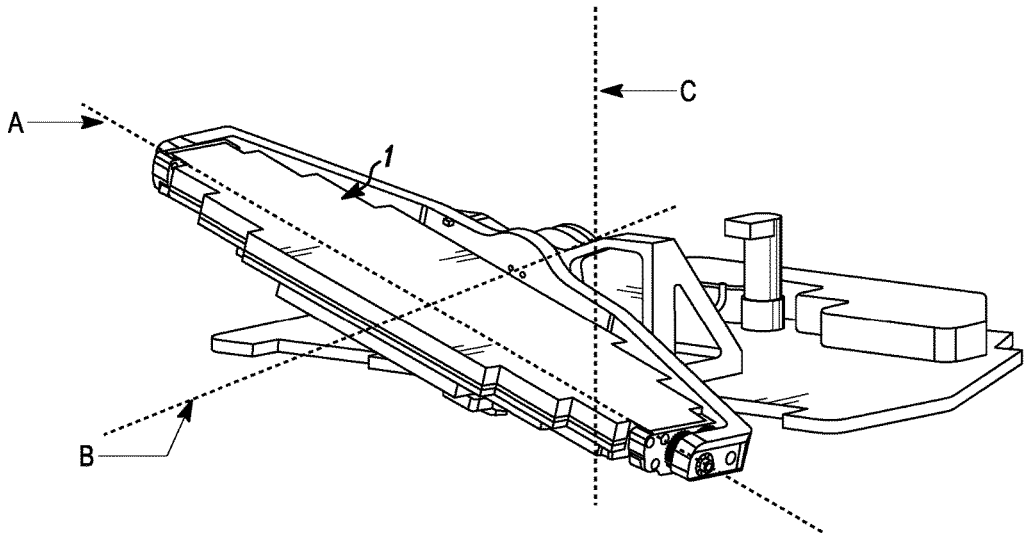
FIGS. 5 to 8 show a positioning system according to embodiments of the present disclosure in different positions of the antenna aperture.

FIGS. 5 to 8 illustrate different alignment scenarios showing that the movement of the positioning system can be implemented in a very small swept volume. The alignment of the aperture in FIG. 5 represents a situation, for example, in which the antenna is located below the equator, however the degrees of longitude of the position of the antenna and that of the target satellite differ. In such a situation, the long axis of the antenna aperture cannot be aligned parallel with the equator by way of a 2-axes positioner, only the short axis of the antenna aperture can. However, the main antenna beam is then very wide, and typically several satellites are located in the beam. In the reception case, the antenna then simultaneously receives the signals of several satellites, which results in undesirable superposition and a significant degradation of the signal from the target satellite. In the transmission case, the transmission power may have to be reduced because otherwise neighboring satellites of the target satellite would also be irradiated, which may not be allowed from a regulatory view.

As is shown in FIG. 5, a positioning system according to embodiments of the present disclosure, with the aid of the axis B, can be used also in such a situation to optimally align the antenna aperture in such a manner that the long axis of the antenna aperture is parallel to the equator. The elevation angle of the satellite then corresponds to the angle about the second axis B (approximately 20°) here, and no longer to the angle about the first axis A, which is then 90° here. The azimuth angle of the target satellite in this special case corresponds to the angle about the third axis C.

Figure 6:
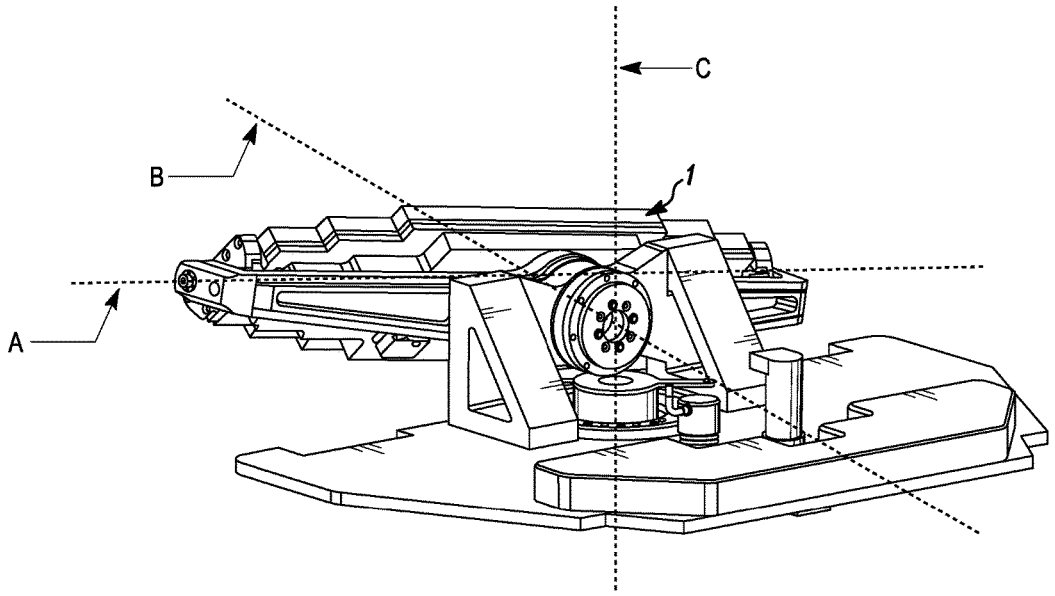
Figure 7:
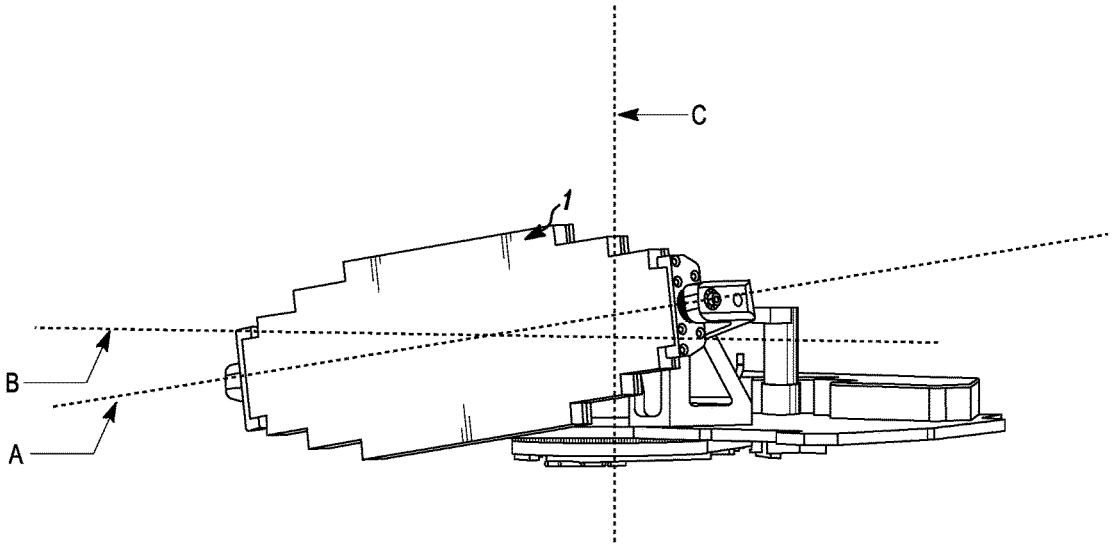
Figure 8:
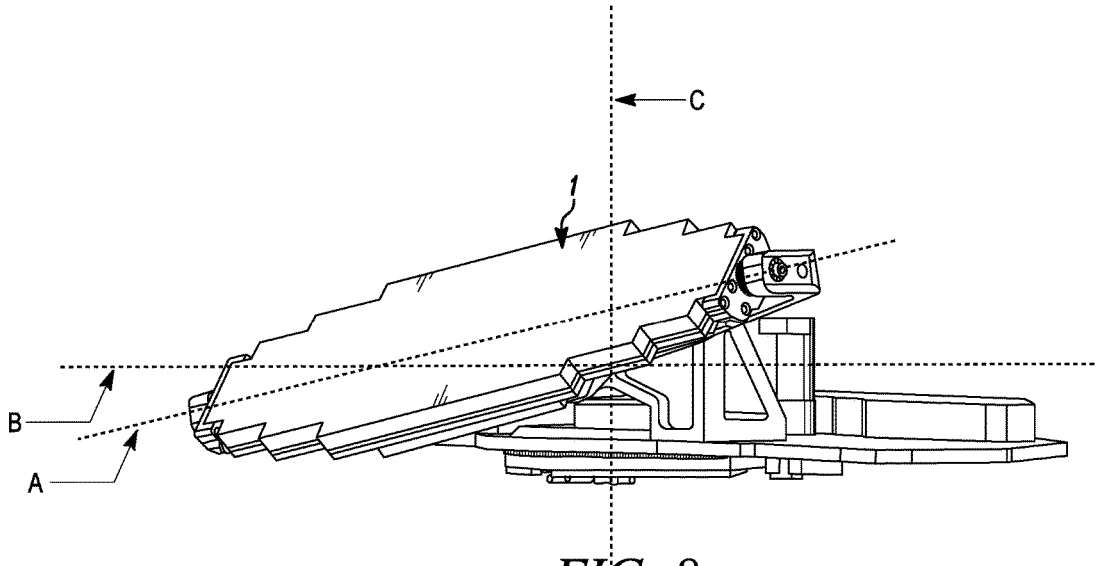

FIGS. 6 to 8 by way of example show further alignment options, which can all be implemented within the same installation space. As described above, in these general cases the alignment with a target satellite with the azimuth angle $\alpha°$ and the elevation angle $\beta°$ results from a rotation $\alpha'$ about the axis C, a rotation $\beta'$ about the axis A, and a rotation $\sigma$ about the axis B, so that $\alpha=\alpha(\alpha', \beta', \sigma)$ and $\beta=\beta(\alpha', \beta', \sigma)$ apply. Because this system of equations is overdetermined, $\alpha'$, $\beta'$ and $\sigma$ can moreover be selected in such a way that the angle formed by the long main axis of the antenna aperture and the tangent to the geostationary orbit at the location of the target satellite is minimized. It may therefore be ensured that the antenna aperture, with respect to the antenna pattern thereof, is optimally aligned with the target satellite under the boundary condition of the limited swept volume.

As is apparent from these figures, it may be advantageous to use antenna apertures that are not exactly rectangular so as to optimally utilize the available swept volume. Oval or stepped shape factors may be suited to aeronautical radomes.

With certain aperture shapes or shapes of the swept volume, it may additionally be advantageous if the respective planes that the axes cross upon rotation about the respective next axis and said next axis are not situated perpendicularly on each other.

Such arrangements can then utilize the available swept volume, for example when the swept volume is not a simple cylindrical volume (which is to say, for example, a truncated cone volume, a spheroid volume, or a volume having constrictions). So as to minimize the moment of inertia, which is to minimize the dynamic load of the axes during operation, it may also be favorable if the planes of movement are not situated perpendicularly on each other. The coordinate system assignable to the axes may be then oblique-angled. The arrangement can work as long as the vectors that form the coordinate system are linearly independent of one another in the three-dimensional space.

Such a positioning system may be characterized by having three axes. The axes may be arranged such that an antenna aperture is provided on a first axis, which is located in a plane that is situated perpendicularly to the main beam direction of the antenna aperture, and can be rotated about the first axis. The first axis is provided on a second axis, and the second axis is provided on a third axis. The axes are connected to each other in such a way that the plane that the second axis crosses upon a rotation about the first axis and the plane that the first axis crosses upon a rotation about the second axis form an angle that is not zero, and the plane that the second axis crosses upon a rotation about the third axis and the plane that the third axis crosses upon a rotation about the second axis form an angle that is not zero.

Figure 9:
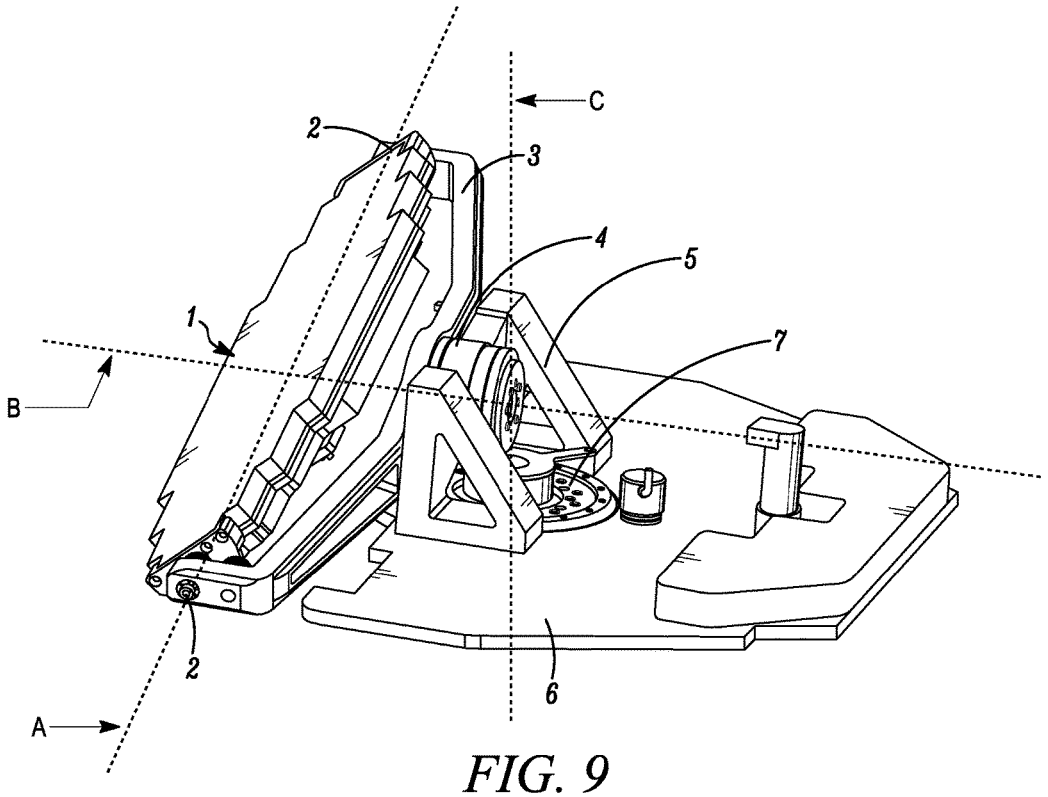
FIG. 9 shows the arrangement of pivot bearings of a positioning system according to embodiments of the present disclosure.

An implementation is illustrated in FIG. 9. On two opposing narrow sides, the antenna aperture 1 is provided by way of a respective first pivot bearing 2 on a U-shaped, substantially centrally mounted bracket 3 having two arms. For apertures having an inhomogeneous mass distribution, the bracket may also be provided in a manner that deviates slightly from the geometric center for weight balancing, but centrally with respect to the mass. The stator of the pivot bearing 2 is located in each case on the bracket 3, and the rotor is located on the respective side of the antenna aperture 1 (not shown separately), so that the antenna aperture 1 can be rotated about the first axis, which passes through the two first pivot bearings 2, in the bracket 3. Because the main beam direction is perpendicular to the aperture area (aperture plane) in the flat antenna aperture shown in FIG. 9, the first axis is located in a plane that is perpendicular to the main beam direction.

On the side that does not intersect the first axis, the bracket 3 is attached to a mounting 5 by way of a second pivot bearing 4, wherein the rotor of the second pivot bearing 4 is located on the bracket 3 and the stator is located on the mounting 5 (not shown separately). The mounting 5 is attached to the rotor of a third pivot bearing 7 with the aid of a positioner platform 6. The stator of the third pivot bearing 7 is typically rigidly connected to the structure of the mobile carrier of the antenna system.

Figure 10:
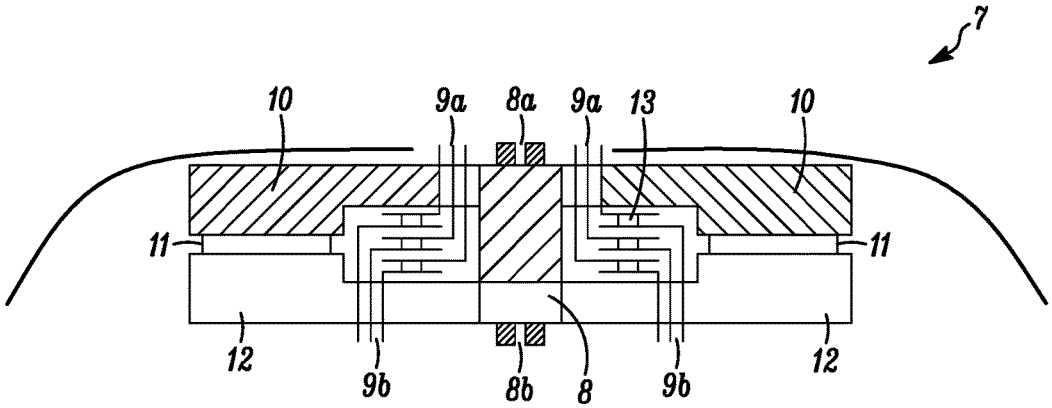
FIG. 10 shows a high-frequency feedthrough at the third pivot bearing of the positioning system shown in FIG. 9.

In an embodiment, the third pivot bearing 7 is designed such that it has an opening in the center in which high-frequency rotary feedthroughs and slip ring rotary feedthroughs can be accommodated. FIG. 10 by way of example illustrates a composition of such a third, encapsulated pivot bearing 7 in a cross-sectional view.

The third pivot bearing 7 is composed of a stator 12 and a rotor 10, which are connected by a bearing 11. The bearing 11 can be designed as a polymer bearing, a ball bearing, or a needle bearing, for example. A high-frequency rotary feedthrough 8 is provided in the rotational axis of the pivot bearing 7. The stator of the high-frequency rotary feedthrough 8 comprising the connections 8*b* (two channels here, for example) is connected to the stator 12 of the pivot bearing 7. The rotor of the high-frequency rotary feedthrough 8 comprising the connections 8*a* is connected to the rotor 10 of the pivot bearing 7. In addition to the high-frequency rotary feedthrough 8, slip rings 9*a*, 9*b* comprising connections for power supply and for controlling the drives are present at the center of the pivot bearing 7, wherein the connections 9*a* belong to the rotor 10 and the connections 9*b* belong to the stator 12 of the pivot bearing 7. Slip bodies 13 ensure a galvanic contact between the connections of the rotor 10 and those of the stator 12.

Three slip ring pairs for 3 channels are shown by way of example. So as to reduce the current load, each channel is broken down into 2 sub-channels. As a result, only half the current flows through each of the (critical) slip bodies. Often times, a breakdown into >2 sub-channels is also carried out.

The signal routing may be likewise carried out via the slip rings. Depending on the requirement, slip ring configurations may have approximately 8 to 32 channels. Of these, approximately 4 to 6 may be used for power supply, and one may be used as an extra for the ground connection, and the remainder for control purposes.

The three axes of the positioning system are each equipped with a motor drive, so that the angle of inclination about the axes can be set separately for each axis. The motors may be electric motors, such as brushless electric motors.

The drive for a rotation about the third axis may be provided on the positioner platform 6 because this may utilize the installation space in the most efficient way, and may be equipped with a gear, which may allow exact alignment.

Figure 11:
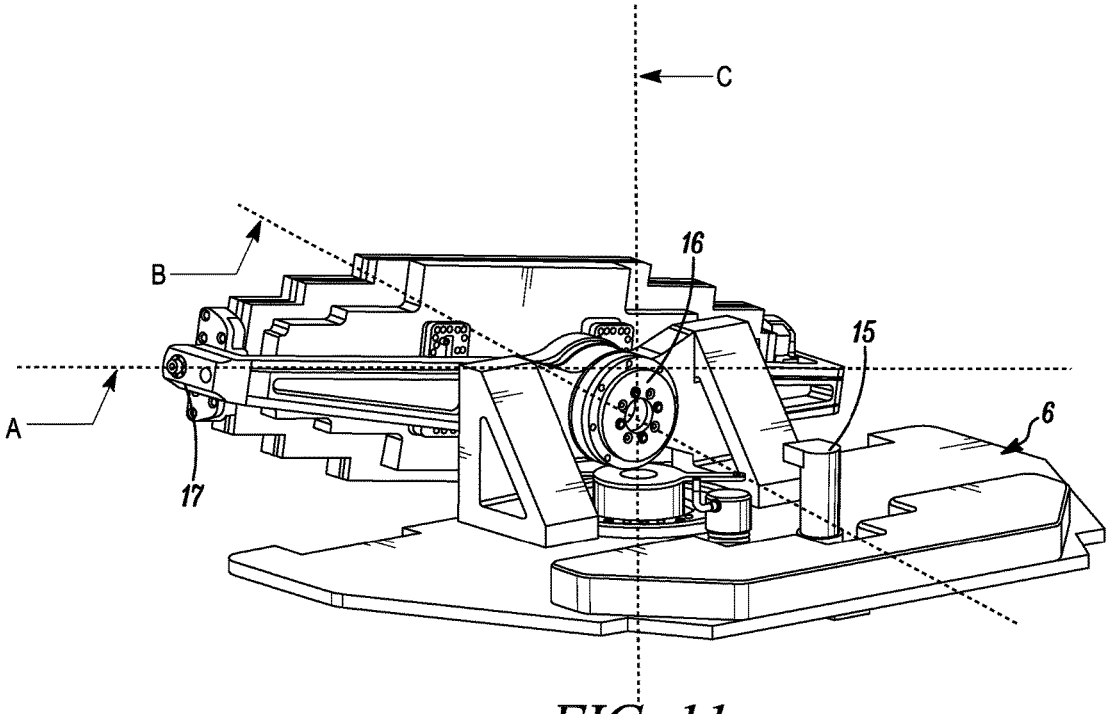
FIG. 11 shows a positioning system according to embodiments of the present disclosure comprising direct drives.

As is shown by way of example in FIG. 11, the drive 15 for a rotation about the third axis is provided perpendicularly on the positioner platform 6, and the gear thereof engages in a toothed ring 19 (see FIG. 3), which is located on the bottom side of the positioner platform 6. This arrangement may allow for high angular resolutions with an appropriate design of the toothed ring 19. Moreover, a drive motor can be directly coupled to a resolver (angular resolution sensor) in a compact design.

The drive 16 for a rotation about the second axis can be designed as a direct drive. This means that no gear may be required here because the axis can be driven directly.

A driving motor 17 for the rotation about the first axis can be provided in or at the bracket. So as not to restrict the swept volume by the drive 17, it may be advantageous here to use a belt drive or a rack drive for driving the first axis. Alternatively, it is also possible to use a direct drive.

Figure 12:
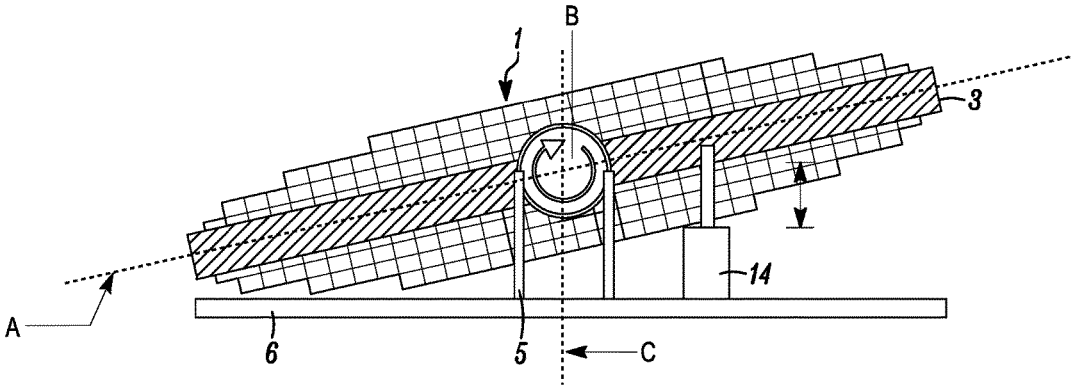
FIG. 12 shows the use of a linear actuator.

Instead of electric motors, it is also possible to use linear actuators 14 for the rotation about the second and first axes. This is shown in FIG. 12. The lifting body of the linear actuator 14 is attached to the bracket 3, the base on the positioner platform 6. This arrangement may also allow the angular position of the bracket 3 about the second axis B to be set in a simple manner. In some arrangements, the angular range about the second axis B may be only up to approximately ±20°, so no motor comprising a gearbox may be needed. This may represent a simplification of the arrangement.

Similarly, the angular position about the first axis can be achieved by way of a linear actuator. Again, the necessary angular range in arrangements may be 0 to 90°. Arrangements comprising multiple actuators for each axis are also conceivable.

Figure 13:
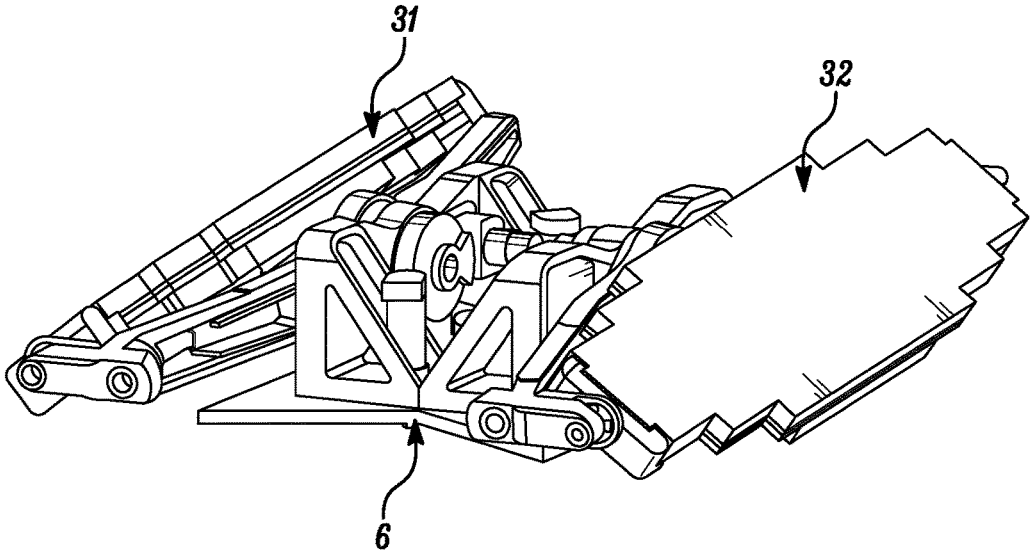
FIG. 13 shows an antenna system comprising two antennas.

FIG. 13 shows an antenna system comprising a first antenna 31 and a second antenna 32, which use a shared positioner platform 6. The positioning systems of the two antennas 31, 32 may be designed corresponding to the variants according to FIGS. 1 to 12. However, the two antennas 31, 32 do not have to be identical. It is also conceivable, for example, to use other positioning mechanisms. The weight and arrangement of the antennas may be selected in such a way that no unbalanced state is created during a movement of the positioning platform 6 about the third axis.

With respect to the aperture, the antennas can be designed for the same frequency band, such as the X band, Ka band, or Ku band. The dimensioning of the aperture is described in WO2010/124867A1 and WO2014/005699A1, for example. In this case, the two antennas 31, 32 can be aligned parallel with the satellite and operated in certain angular scenarios with respect to the satellite. The signal currents via the two antennas 31, 32 can then be combined in a transceiver unit, which is not shown, in the reception case and divided in the transmission case.

Alternatively, the first antenna can be operated in the Ka band and the second antenna in the Ku band. Depending on availability or costs of the satellite connection in the Ka or Ku band, it is therefore possible to select the respective more favorable one in terms of power and cost. It should be noted that the antennas, which may differ with respect to the aperture, may be matched to each other in regard to weight and weight distribution.

In the symmetrical arrangement in regard to weight and centers of gravity of the two antennas 31, 32 about the third rotational axis, a synchronous movement of the two antennas 31, 32 also about the first and second rotational axes (so-called butterfly operation) may offer additional advantages. Regardless of whether both antennas 31, 32 are being operated, the bracket and pivot bearing for the first and second rotational axes of the two antennas 31, 32 may pivot substantially synchronously. In this way, the loads for the motor and gearbox can be minimized.

What is claimed is:

1. A positioning system, comprising:

a bracket;

a mounting;

a positioner platform;

an antenna aperture having two opposing sides each attached to the bracket via respective first pivot bearings arranged along a first axis, wherein the antenna aperture is configured to rotate about the first axis;

a second pivot bearing attaching the bracket to the mounting, and arranged along a second axis, wherein the bracket is configured to rotate about the second axis;

a stop configured to limit a rotational movement of the bracket on the second axis to within 180 degrees; and a third pivot bearing attaching the mounting to the positioner platform, and arranged along a third axis, wherein the mounting is configured to rotate about the third axis, wherein the first axis and the second axis form an oblique angle, and the second axis and the third axis form an oblique angle, when the first axis rotates about the second axis, the first axis is configured to cross a first imaginary plane that is perpendicular to the second axis, and when the second axis rotates about the third axis, the second axis is configured to cross a second imaginary plane that is perpendicular to the third axis.

2. The positioning system according to claim 1, wherein the first axis is located in a plane that is perpendicular to a main beam direction of the antenna aperture.

3. The positioning system according to claim 1, further comprising a drive configured to drive the third pivot bearing via a toothed ring arranged beneath the positioner platform, wherein the drive is arranged perpendicularly to the positioner platform.

4. The positioning system according to claim 1, wherein the antenna aperture has an oval or stepped oval shape.

5. The positioning system according to claim 1, wherein the respective first pivot bearings are limited to a rotation from 0 degrees to 90 degrees.

6. The positioning system according to claim 1, wherein the third pivot bearing allows a rotation from 0 degrees to 360 degrees.

7. The positioning system according to claim 1, further comprising a linear actuator configured to provide a rotational movement of the antenna aperture about the first axis, and a rotational movement of the bracket about the second axis.

8. The positioning system according to claim 1, wherein the first pivot bearings are configured to rotate the antenna aperture via a direct drive and the second pivot bearing is configured to rotate the bracket via a direct drive.

9. The positioning system according to claim 1, wherein the third pivot bearing comprises at least two separate slip ring pairs configured to ensure power supply to drives of the first and second pivot bearings and control the drives.

10. The positioning system according to claim 9, wherein at least one of the drives is a brushless electric motor.

11. The positioning system according to claim 1, wherein the third pivot bearing includes a high-frequency rotary feedthrough configured to conduct signals from and to the antenna aperture.

12. The positioning system according to claim 11, further comprising:

a flexible coaxial conductor configured to transmit signals to the high-frequency feedthrough.

13. The positioning system according to claim 11, wherein the high-frequency rotary feedthrough is configured to conduct high-frequency signals from and to the antenna aperture via two high-frequency channels.

14. The positioning system according to claim 11, wherein the high-frequency rotary feedthrough is encapsulated.

15. The positioning system according to claim 1, wherein the antenna aperture is a first antenna aperture, the positioning system further comprising:

a second antenna aperture.

16. The positioning system according to claim 15, wherein the first antenna aperture is operated in the Ka band and the second antenna aperture is operated in the Ku band.

17. The positioning system according to claim 15, wherein the first antenna aperture and the second antenna aperture are each operated in the Ka band or Ku band.

18. The positioning system according to claim 15, wherein the first antenna aperture and the second antenna aperture are configured to rotate synchronously to each other.

19. The positioning system according to claim 1, wherein the stop is configured to limit the rotational movement of the bracket about the second axis to less than positive 45 degrees and greater than negative 45 degrees.

20. The positioning system according to claim 19, wherein the stop is configured to limit the rotational movement of the bracket about the second axis to less than positive 20 degrees and greater than negative 20 degrees.

* * * * *